US006101629A

United States Patent [19]

Colling

[11] Patent Number: 6,101,629

[45] Date of Patent: Aug. 15, 2000

[54] KNEE CHAP

[76] Inventor: Jill A. Colling, 4303 Mackinaw Rd., Bay City, Mich. 48706

[21] Appl. No.: 09/186,716

[22] Filed: Nov. 5, 1998

[51] Int. Cl.[7] ..... A41D 13/06

[52] U.S. Cl. ..... 2/24; 2/22; 2/911; 119/850; 602/26; 128/882

[58] Field of Search ..... 2/22, 24, 16, 455, 2/911; 54/65, 80.1, 82; 119/850, 856; 602/5, 23, 26, 27; 128/846, 882

*Primary Examiner*—John J. Calvert
*Assistant Examiner*—Tejash D Patel
*Attorney, Agent, or Firm*—Robert L. McKellar

[57] ABSTRACT

A knee chap which is capable of providing protection from the abrasive nature of riding a horse or other such animal. The knee chap provides a pad for that part of the knee which is against the animal such that the abrasive effect of the saddle or the animal's movement is not transferred to the knee. The device is configured for a human knee when riding a horse.

12 Claims, 4 Drawing Sheets

KNEE CHAP

The invention disclosed and claimed herein deals with a knee chap which is capable of providing protection from the abrasive nature of riding a horse or other such animal and to improve knee grip, whether riding with a saddle or bareback. The knee chap provides a pad for that part of the knee which is against the saddle or the animal such that the abrasive effect of the animal's movement is not transferred to the knee. This device is configured for a human knee wherein the human is mounted in the normal manner on the animal. It is designed to protect the knee during long periods of time for all styles of riding, for example, western, english, trail, endurance, and bareback riding. This device is particularly useful for persons wishing to ride animals while wearing shorts or bathing suits or other garments such that the legs and knees of the person are not generally covered, or for persons participating in lengthy trail or endurance type riding.

BACKGROUND OF THE INVENTION

This invention deals with a knee chap which is capable of providing protection from the abrasive nature of riding an animal. The inventor is unaware of any publications which describe such a device.

The device of this invention has the benefits of easy application and easy removal from the knee of a person, is long lasting in its use, and can be modified to provide a safety effect, in that the materials that are used to manufacture the device can be those that are fluorescent orange or some other safety color.

THE INVENTION

The invention herein deals with a device which is a knee chap capable of providing protection from the abrasive nature of riding an animal.

Such a device is a knee chap comprising a contact pad having a flat planar configuration, an outside surface, a front edge, a back edge, an upper edge, and a lower edge. The contact pad has attached to it a strap arrangement comprised of two straps, wherein one strap is an upper strap having two ends, and one strap is a lower strap having two ends. The ends of the respective straps are equipped with a means for fastening the ends of the respective straps together. Also, the upper strap is fixed to the outside surface of the contact pad and near its upper edge and the lower strap is fixed near the lower strap to the outside surface of the contact pad near its lower edge.

The upper and lower straps have a divergent configuration with respect to each other as they extend beyond the front edge of the contact pad and the upper and lower straps have a convergent configuration with respect to each other as they extend beyond the back edge of the contact pad such that when the ends of the upper strap are respectively positioned one over the other in a closed position, the upper strap fastens and closes above the knee of a human subject, and when the ends of the lower strap are respectively positioned, one over the other in a closed position, the lower strap fastens and closes below the knee of said human subject to hold the contact pad in a stable position around the knee with the contact pad facing the inside of the knee to provide protection from the abrasive effect of the hide of the animal against the inside of the knee.

DETAILED DESCRIPTION OF THE INVENTION

Figure 1:
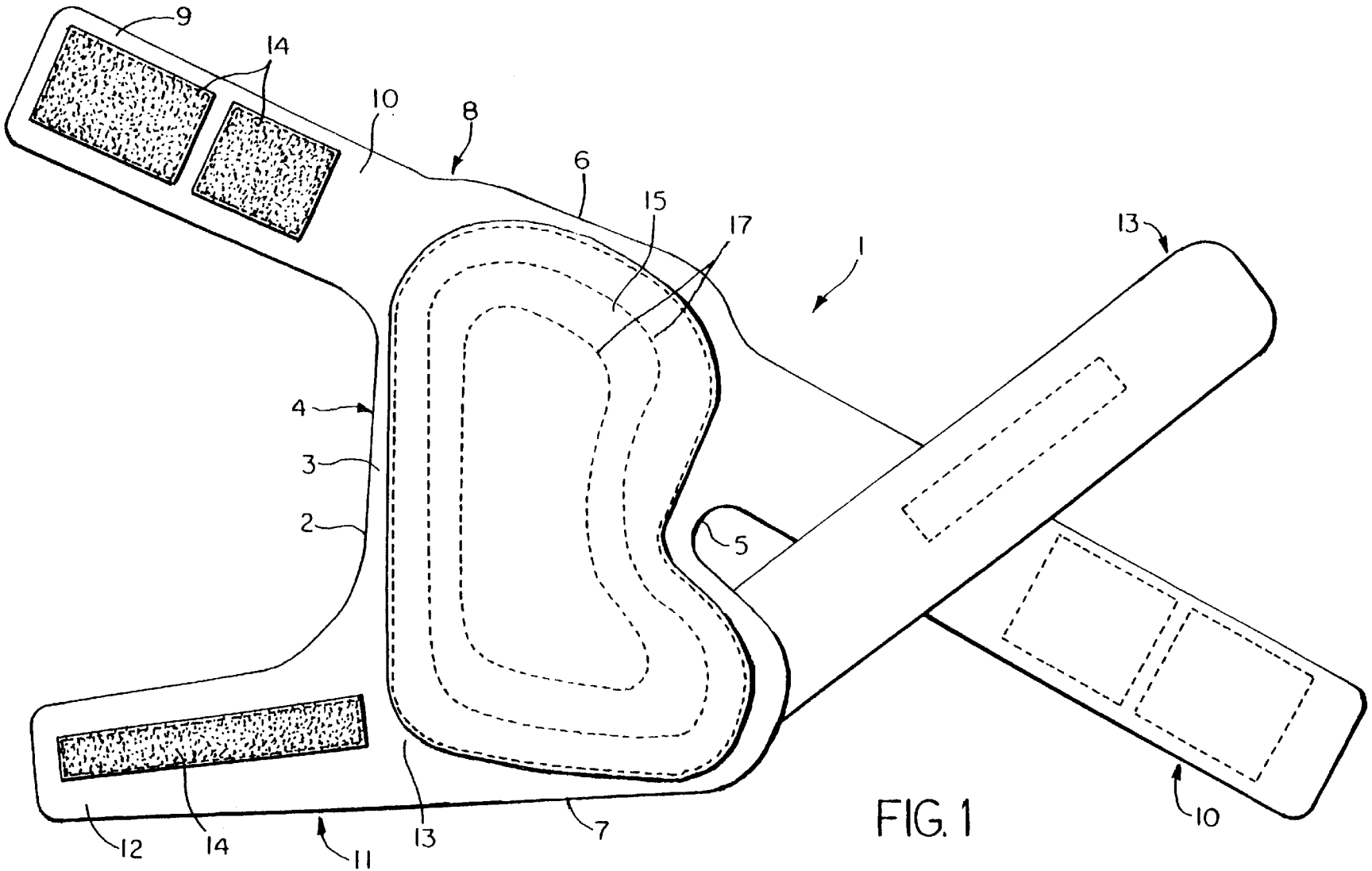
FIG. 1 is a full view of the inside of the device of this invention spread flat and illustrating a padded chap.

Now, with specificity, and with regard to FIG. 1, there is shown a full view of the inside of the knee chap 1 of this invention as it is spread flat for illustration purposes.

There is shown the contact pad 2 which has a flat planar configuration, shown essentially in the plane of the paper containing the Figure. Shown in this Figure is the inside surface 3, the front edge 4, the back edge 5, the upper edge 6, and the lower edge 7, of the contact pad 2.

Figure 2:
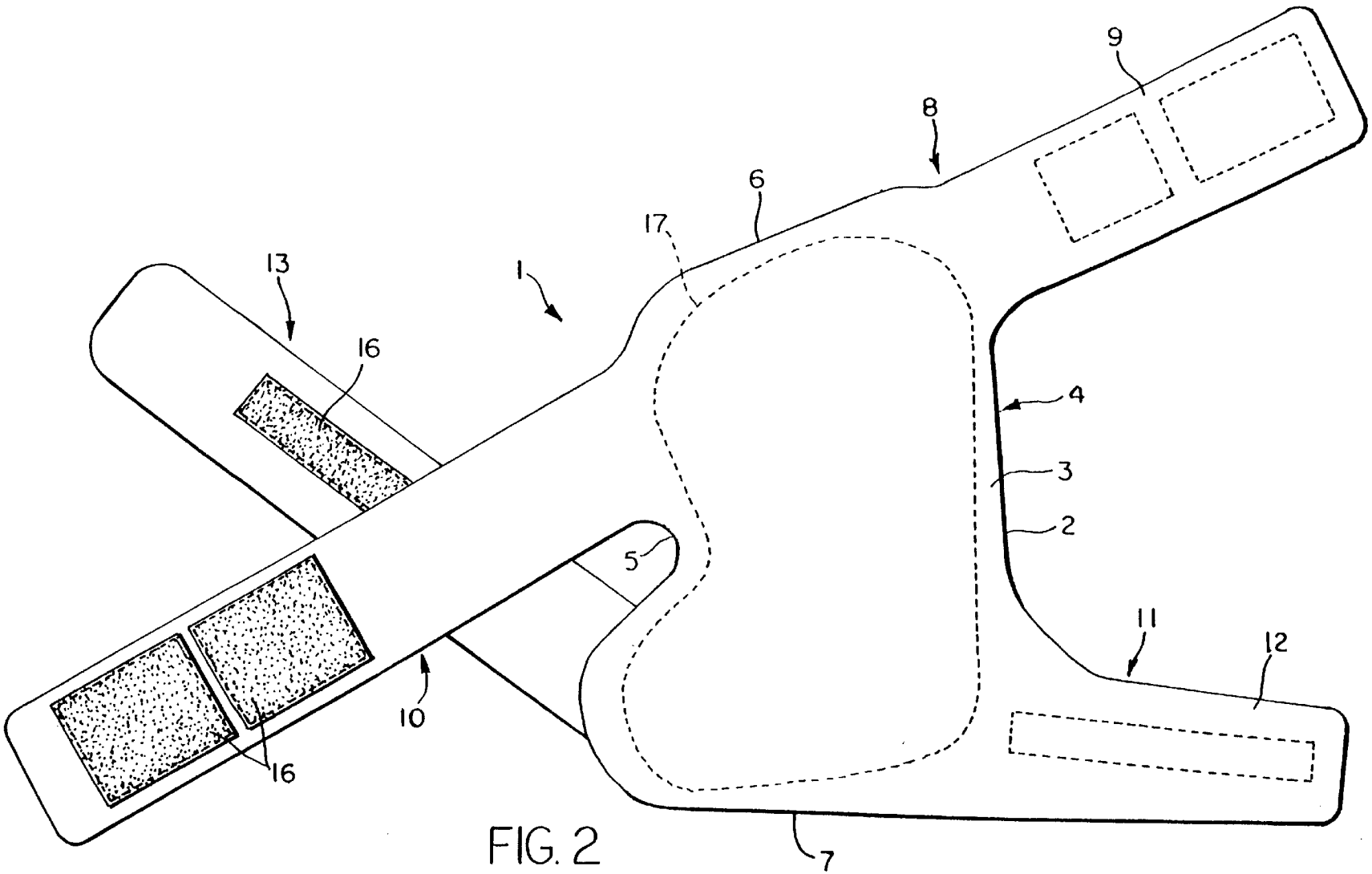
FIG. 2 is a full view of the outside of the device of this invention spread flat.

There is also shown the upper strap 8, with front end 9 and back end 10, and the lower strap 11 showing the front end 12 and the back end 13. There is also shown on the ends 9 and 12, attachment means 14, which in this illustration is the cloth half of a Velcro® fastener (the hook half is shown in FIG. 2 as 16. Finally, there is shown a pad 15 fixed on the inside surface 3 of the contact pad 2.

Figure 5:
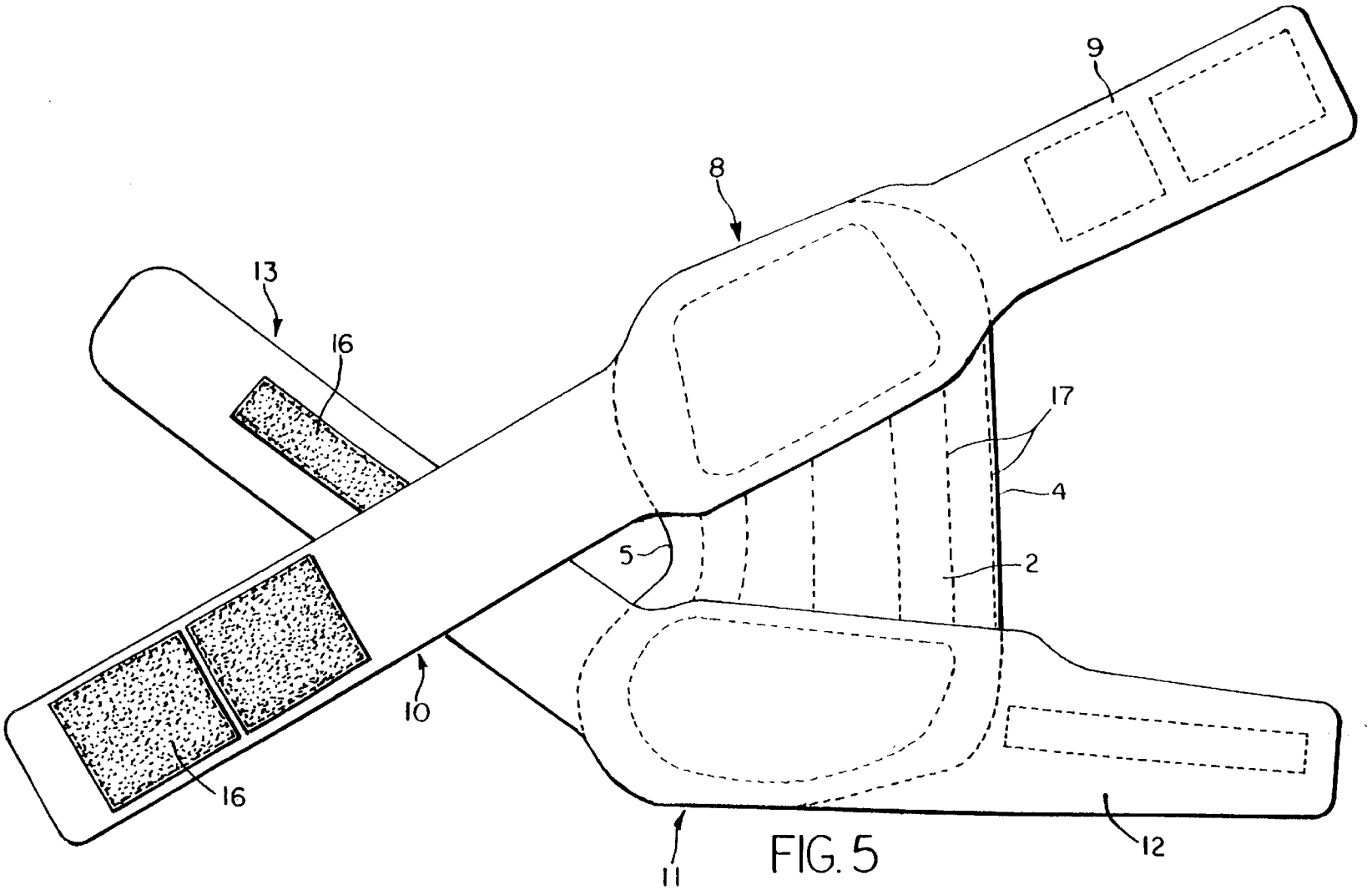
FIG. 5 is a full view of the outside of the device of this invention spread flat and shown separate straps which are not integral with the contact pad.

It should be noted that the straps 9, 10, 12, and 13 are shown as an integral part of the contact pad 2, however, they can be separately attached straps as well as is shown in FIG. 5.

Returning to FIG. 2, there is shown a full view of the outside of the chap 1 of this invention, spread flat. This view shows the straps 9, 10, 12, and 13 as an integral part of the contact pad 2 In addition, this view shows the other half of the fastening means 14, which are the hook portions 16 of the Velcro® fastening means. Also shown for purposes of illustration, but not as a limiting means of construction, are the multiple sew lines 17.

It should be noted that the straps 9 and 12 form a divergent configuration at the front edge 4 of the contact pad 2 and the straps 10 and 13 form a divergent configuration at the back edge 5 of the contact pad 2. These configurations are not overly critical and are configured such that they can come together around the top and the bottom of the knee 20 to make a comfortable fit. Parallel straps would not allow for the straps to meet each other for fastening purposes and thus, the device could not be fastened in place.

Figure 3:
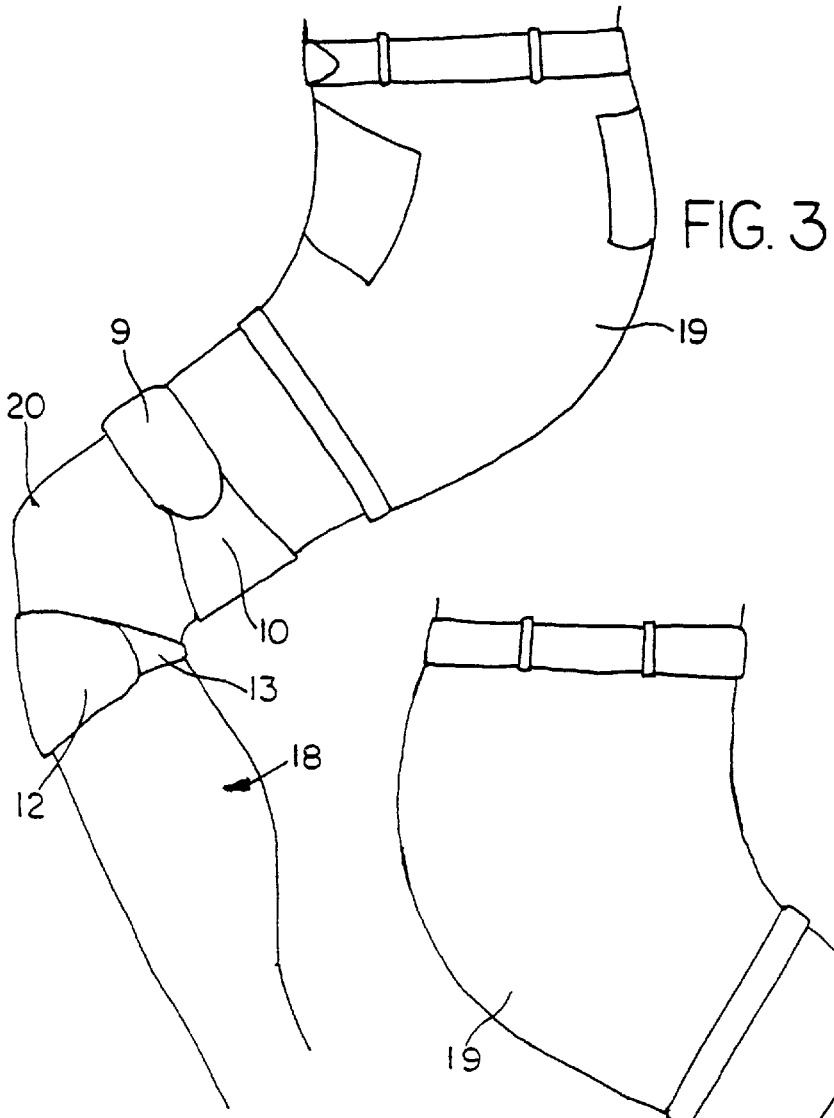
FIG. 3 is a view of the left side of a portion of the human body with a device of this invention in place about the knee.

Thus, when the ends 9 and 10 of the upper strap 8 are respectively positioned one over the other in a closed position as is shown in FIG. 3, the upper strap 8 closes above the knee 20 of a human subject 18. The portion of the human subject 18 is shown wearing a pair of shorts 19.

Figure 4:
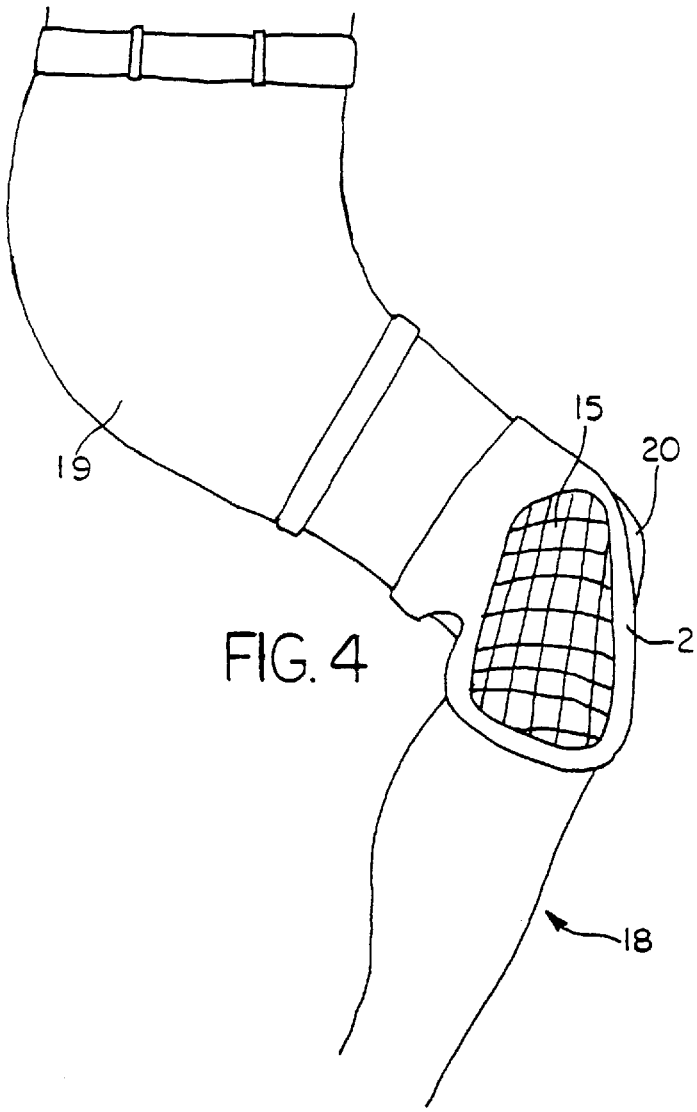
FIG. 4 is a view of the opposite side of the knee, showing the padded portion of the device.

Likewise, when the ends 12 and 13 of the lower strap 11 are respectively positioned, one over the other in a close position, the lower strap 11 closes below the knee 20 of the human subject 18 to hold the contact pad 2 in a stable position about the knee 20 with the contact pad 2 facing the inside of the knee as is shown in FIG. 4, with the padded portion 15 facing outwardly.

It should be noted that the pad and straps 9, 10, 12, and 13 can be varied in size and length to accommodate any size of person, and it should be noted that included within the scope of this invention are both left leg and right leg devices, as it will become apparent to those skilled in the art upon a reading of this specification and drawings, that the same construction will not accommodate both the left and right knees.

Although VELCRO has been illustrated in these Figures, it is contemplated within the scope of this invention to use any fastening means that will fasten straps such that the device will fasten securely to the knee and is easy to use. In addition, the fastening means should preferably be capable of adjusting in size and length. Thus, in addition to the illustrated fastener, one can use a buckle arrangement, a hook and eye arrangement, or laces in eyes or hooks.

Preferably, the materials of construction should provide a chap that is lightweight and thin, but still provides the protection desired. Preferred for this invention are leather, suede, cloth, rubber, foam, foam rubber, and the like. The materials of construction can have a variety of colors, including bright or fluorescent oranges, reds, or yellows, which can be used for safety purposes. It is contemplated within the scope of this invention to include modifications to the chaps that will provide luminescence, also for safety purposes.

The chaps of this invention are easy to manufacture and use and are durable for long periods of time. They are also small enough that they can be easily stored or carried.

It is contemplated within the scope of this invention to provide for a knee chap that is of unitary construction, and therefore, except for the strap fasteners, no other means of construction is considered necessary. However, when it is desired to fabricate the knee chap from various pieces, such as, separate straps, or separate pads, or the like, the means of fastening these pieces together is not critical, as long as the pieces substantially remain durable. For example, it is contemplated within the scope of this invention to fabricate by sewing, gluing, fastening using VELCRO, and the like, or a combinations of these means.

What is claimed is:

1. A knee chap comprising:

(i) a contact pad having a flat planar configuration, an outside surface, an inside surface, a front edge, a back edge, an upper edge, and a lower edge, said contact pad having attached thereto, (ii) a strap arrangement comprised of two straps, wherein one strap is an upper strap having two ends, and one of the is a lower straps having two ends, wherein the ends of the respective one of the straps are equipped with a means for fastening the ends of the respective straps together, and wherein, said upper strap is fixed to the outside surface of the contact pad near its upper edge, the lower strap is fixed to the outside surface of the contact pad near its lower edge;

said one end of upper and lower straps having a divergent configuration with respect to each other, and extending beyond the front edge of the contact pad;

the other end of said upper and lower straps having a convergent configuration with respect to each other, and extending beyond the back edge of the contact pad such that when the ends of the upper strap are respectively positioned one over the other in a closed position, the upper strap fastens and closes above the knee, and when the ends of the lower strap are respectively positioned, one over the other in a closed position, the lower strap fastens and closes below the knee to hold the contact pad in a stable position about said knee.

2. A knee chap as claimed in claim 1 wherein the contact pad has in addition, a padded surface on the inside surface of the contact pad.

3. A knee chap as claimed in claim 1 wherein the material of construction is suede.

4. A knee chap as claimed in claim 1 wherein the material of construction is leather.

5. A knee chap as claimed in claim 1 wherein the material of construction is cloth.

6. A knee chap as claimed in claim 1 wherein the material of construction is selected from two or more materials selected from a group consisting essentially of:

(i) suede, (ii) leather, (iii) cloth, (iv) rubber, (v) foam, and (vi) foam rubber.

7. A knee chap as claimed in claim 1 wherein the fastening means for the straps is adjustable for length.

8. A knee chap as claimed in claim 7 wherein the fastening means is a hook and loop fastener.

9. A knee chap as claimed in claim 7 wherein the fastening means is a strap and buckle arrangement.

10. A knee chap as claimed in claim 7 wherein the fastening means is a lace and eye arrangement.

11. A knee chap as claimed in claim 7 wherein the fastening means is a lace and hook arrangement.

12. A knee chap as claimed in claim 1 having adjustable size and length.

* * * * *